US006692003B2

(12) United States Patent
Potter et al.

(10) Patent No.: US 6,692,003 B2
(45) Date of Patent: Feb. 17, 2004

(54) PARLAY SIDE BET METHOD

(76) Inventors: Bruce H. Potter, P.O. Box 335, Huntington Beach, CA (US) 90740; Deborah J. Potter, P.O. Box 335, Huntington Beach, CA (US) 90740

( * ) Notice: Subject to any disclaimer, the term of this patent is extended or adjusted under 35 U.S.C. 154(b) by 0 days.

(21) Appl. No.: 09/837,240

(22) Filed: Apr. 18, 2001

(65) Prior Publication Data

US 2002/0020965 A1 Feb. 21, 2002

Related U.S. Application Data

(60) Provisional application No. 60/197,997, filed on Apr. 18, 2000.

(51) Int. Cl.[7] ..... A63F 1/00

(52) U.S. Cl. ..... 273/274; 273/292; 263/11

(58) Field of Search ..... 273/292, 274; 463/11–13

(56) References Cited

U.S. PATENT DOCUMENTS 5,636,843 A * 6/1997 Roberts ..... 273/292
RE35,864 E * 7/1998 Weingardt ..... 463/25
6,123,335 A * 9/2000 Adkins ..... 273/274
6,227,969 B1 * 5/2001 Yoseloff ..... 271/143 R
6,312,334 B1 * 11/2001 Yoseloff ..... 273/138.1
2002/0025845 A1 * 2/2002 Cannon ..... 463/16

* cited by examiner

*Primary Examiner*—Benjamin H. Layno
*Assistant Examiner*—Vishu Mendiratta

(57) ABSTRACT

The present invention discloses a method wherein a side bet game is integrated with a base casino game. The side bet is based on the outcome of a random event or multiple random events that takes place before the base casino game begins. A wide variety of random events could be utilized, such as: the value, color or suit of a random card, the roll of dice, the spin of a wheel or slot reel, the flip of a coin, electronically displaying a random number on display means, etc. If the player wins the side bet, both the amount wagered and the amount won become a mandatory wager, and must be wagered on the immediately following hand of the base casino game. One type of embodiment of the present invention will require that if the player loses the side bet game, the side bet is collected, and the player must place a wager in order to participate in the immediately following hand of the base casino game. Another type of embodiment of the present invention will require that if the player loses the side bet only a portion of the side bet will be collected the remainder must be wagered on the base casino game.

26 Claims, 2 Drawing Sheets

PARLAY SIDE BET METHOD

This application claims benefit to provisional application Ser. No. 60/197,997, filing date Apr. 18, 2000.

BACKGROUND

1. Field of Invention

The present invention pertains to the field of wagering games, more specifically a side betting system that is integrated with a wagering game.

2. Description of Prior Art

A wide variety of side bet systems have been added to many casino games. A side bet is an additional wagering opportunity that is added to a casino game. Side bet systems require that the player place a casino game wager in order to have an opportunity to place the side bet. The current side bet systems are separate from the casino games upon which they are added, and do not affect the outcome of the casino game wager. Side bets are independent wagers and are kept separate, at all times, from the casino game wagers. Typically, when a side bet system is added to a casino game, a player that places the side bet is wagering that a predetermined random event will occur during the play of the casino game. Predetermined random events include, but are not limited to, the value of the dealers' hand, the value of the players' hand, the combination(s) of cards that will be dealt, the suit(s) of the cards that will be dealt; some side bet systems will be based on the procedures of the casino game that they are added to, still others will depend on the same event occurring on more than one hand in a row. Currently, all side bet systems are based on the possible occurrence of a random event(s) taking place during the hand of the casino games upon which they are added.

A known side bet system called Royal Match 21™ has been added to the game of Blackjack. This side bet systems offer players an opportunity to place a side bet prior to the deal of the Blackjack game. A player who places the side bet is wagering that the first two cards dealt to their hand will be of the exact same suit. If the players' first two cards are not of the exact same suit, the player will lose their side bet. If the players' first two cards are of the exact same suit, the player receives a predetermined payout based upon the value of the players' cards, i.e. a suited King and Queen have the highest payout. The side bet is reconciled and the Blackjack game continues as normal. The outcome of the side bet system is separate from, and does not affect the Blackjack game.

Another side bet system that has been added to Blackjack is known as 21 Madness™. This side bet system offers the player an option to wager a fixed monetary amount on the side bet (typically $1.) If the player places the side bet and gets a natural BlackJack (an Ace, and a Ten or Face card) the player activates an electronic device that determines a bonus payout. The payouts can range from $5 to $1,000 with the $5 payout being more common than the $1,000 payout. Once the bonus amount is determined, the bonus is awarded to the player and the Blackjack game continues as normal. The side bet system has no affect on the outcome of the Blackjack game.

U.S. Pat. No. 6,312,334 (to Yoseloff) discloses a video gaming system wherein two or more different games are played. In this system, the player wagers to play the first game until a certain predetermined winning combination is achieved. However, the player cannot move on to the second part of the game until this predetermined winning combination is achieved. Once the player has reached a predetermined condition, only then can the player be allowed to wager any or all of the winnings from the predetermined winning combination on the second part of the game. Between play of each number of the first segment, the player has the option to continue or cash out and quit. If the player does not have any credits remaining, the player's only alternative is to quit playing the first segment. The player can play the first segment over and over again, until they win, and then cash out or run out of money or credits and quit at any time. There is no requirement to parlay any amounts won onto the second segment, because the second segment is not integrated with the first segment.

U.S. Pat. No. 5,174,579 (to Griffiths) discloses a side bet system (referred to as a "21 or over" wager) that is added to the game of Blackjack. The player is offered an opportunity to wager on whether the dealer will either bust (exceed a point value of 21) or achieve a hand count of exactly 21 during each round of play. The Twenty-One game is played out according to the conventional method of play, where the normal winning and losing hands are paid or collected by the dealer. The dealer then reconciles the additional separate "21 or over" wagers based on whether the dealer has either busted (gone over a count of twenty-one) or achieved a hand count of exactly twenty-one during the play of the dealer's hand in the Blackjack game. This additional "21 or over" wager can be paid according to predetermined odds, such as one-to-one odds or others, as determined by the casino. The payout for the side bet system will be paid to the player regardless of the outcome of the player's Blackjack hand; it is separate from and does not affect the Blackjack game.

Yet another known side bet system has been added to the casino game of Pai Gow Poker and is called Bonus Pai Gow Poker. The Bonus Pai Gow Poker side bet system offers players the opportunity to place a side bet on the final rank of their hand. This side bet system offers varying payouts based on the rank of the players hand during the hand of Pai Gow Poker, i.e. 2 to 1 for a 5-card straight or 5,000 to 1 for a 7-card straight flush. If a player bets $5.00 or more on the side bet, the player qualifies for bonus payouts based upon the rank of the other players' hands. The side bet system payouts are paid to the player regardless of the outcome of their Pai Gow Poker hand as it relates to the game of Pai Gow Poker; it is separate from and does not affect the outcome of the Pai Gow Poker game.

A multitude of side bet systems have been added to conventional casino games, and are currently being played. The outcomes of all side bet systems are currently based upon a predetermined sequence of cards being reached, or predetermined event(s) taking place during the round of play of the associated casino game, etc. Therefore, the money wagered on current side bet systems is separate from the money wagered on the casino game. The current side bet systems are independent and do not affect the amount wagered on the casino game. Players would welcome a side bet that is more integrated with the casino game of which it is associated. Many players would like to participate in wagering games that allowed them to wager their side bet and amount won or portion thereof, on the immediately following hand of the associated casino game. Casinos would see greater profits from side bet systems if the players could immediately wager the side bet winnings, or portion thereof, since it would increase the amount wagered on the associated casino game.

Objects and Advantages

It is an object of the present invention to provide a side bet game that is both fair and exciting for casino game players, thereby intensifying the gaming action of the base casino game.

It is an object of the present invention to integrate a side bet game with a base casino game by requiring that all winning side bets (the amount bet and the amount won) are parlayed as a mandatory wager on the immediately following hand of the base casino game.

It is an advantage of the present invention that the amount wagered on the base casino game will increase since the winning side bets (the amount bet and the amount won) must be wagered on the immediately following hand in the base casino game.

It is an advantage of the present invention that adding the side bet game of the present invention to a base casino game will have a direct positive effect on the revenue of the base casino game.

Still further objects and advantages will become apparent from a consideration of the ensuing detailed description.

REFERENCE NUMERALS

Figure 1:
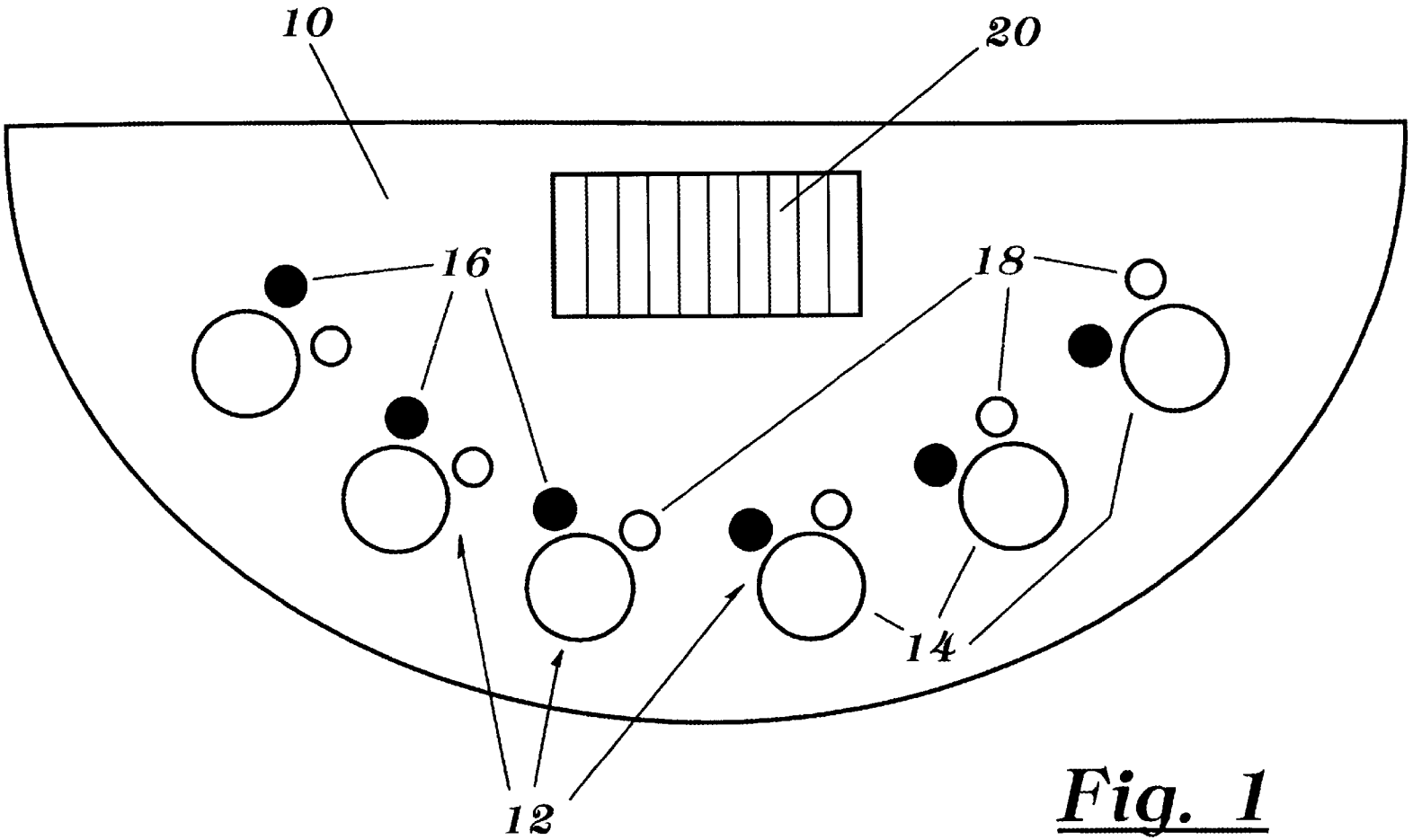
FIG. 1 Shows a top view of a table that could be useful for the preferred embodiment of the present invention.

10 Playing Surface
12 Player Station
14 Casino Game Wager Area
16 Black Wager Area
18 Red Wager Area
20 Chip Tray
22 Rotatable Reels
24 Additional Reel
28 Coin Slot
29 Bill Validator
30 "Bet One" Button
32 "Bet Max" Button
34 "Spin Reels" Button
35 "Play Bonus" Button
36 "Cash Out" Button
38 Coin Payout Opening
40 Pay Table Area
42 Coin Receiving Tray
44 Payline
46 Bonus Pay Area

SUMMARY

The present invention is novel to the field of casino games, wherein a side bet game is integrated with base a casino game. The side bet of the present invention can be implemented as an optional wager or a mandatory ("ante"-type) wager based on the outcome of a random event or multiple random events that takes place before the base casino game begins. A wide variety of random events could be utilized, such as: the value, color or suit of a random card, the roll of dice, the spin of a wheel or slot reel, the flip of a coin, electronically displaying a random number on display means, etc. If the player wins the side bet game, both the amount wagered and the amount won become a mandatory wager, and must be wagered on the immediately following hand of the base casino game. One type of embodiment of the present invention will require that if the player loses the side bet, the bet is collected, and the player must place a wager in order to participate in the immediately following hand of the base casino game. Another type of embodiment of the present invention will require that if the player loses the side bet only a portion of the side bet will be collected the remainder must be wagered on the base casino game.

The preferred embodiment integrates the side bet game of the present invention with a base casino game of Blackjack, also known as Twenty-One. Prior to any cards being dealt, either electronically or by a dealer (with or without a shuffling machine or continuous shuffling machine), the player is offered the opportunity to place a side bet on whether the first card off the deck will be of a red suit, or of a black suit (red or black.) Once all players have been given the opportunity to place the side bet, one card will be "burned," (removed from play.) The dealer will expose the "burned" card, and if the card's suit is of a Red color, (a Heart or a Diamond,) then all players who wagered on red will be paid even money. Then their side bet, plus the amount won on the side bet must be placed into the Blackjack wagering area, and both must be wagered on the immediately following hand of the base game, Blackjack. All players who wagered on black will lose and the dealer will collect their side bet. If the "burned" card is of a Black color, (a Spade or a Club,) then all players who wagered on black will be paid even money. Then their side bet, plus the amount won on the side bet must be placed into the Blackjack wagering area, and both must be wagered on the immediately following hand of the base game, Blackjack. All players with a wager on red will lose and the dealer will collect their side bet. Any player that lost the side bet will be afforded an opportunity to place a Blackjack game wager to participate in the base Blackjack game. If preferred by the house, players with winning side bets could be offered the option of adding to their wager. The present invention could also allow for the side bet to be based on whether the first card in play will be red or black, and not based on the "burn" card. The preferred embodiment could be played where the side bet game is not optional and the players would be required to wager red or black in order to participate in the base game of Blackjack.

In an alternate expression of the preferred embodiment, the side bet game is based on the specific suit (Spade, Heart, Diamond, or Club) of the "burn" card. If the player placed the side bet on the suit of the "burn" card, the player would be paid 3 to 1 on the side bet; the side bet and the entire amount won must be wagered on the immediately following hand of the base game, Blackjack.

The above described embodiments of the present invention do not provide for a percentage advantage to the casino or "bank" within the side bet game; the advantage is derived from the integrated casino game, wherein the player is forced to wager their side bet, plus the amount won from the side bet, in a base casino game wherein the casino does have a percentage advantage. However, a percentage advantage could be incorporated into the side bet game, using different methods. One method is where a non-value card, or cards (i.e.: a Joker) is added to the deck, therefore creating an imbalance in the deck. When a non-value card appears as the "burn" card, the players lose, and all side bets (red and black, or specific suit) are collected by the casino.

Still, further embodiments of the present invention are employed wherein a player in the side bet game who wins is paid even money, and a player in the side bet game who loses will only lose a predetermined portion (i.e. one half) of their side bet. Regardless of whether a player wins or loses in the side bet game, the remaining side bet, or portion thereof, plus all amounts won, if any, must be wagered on the immediately following hand of the base casino game. This type of side bet game could be integrated with casino gaming machines, such as slot machines and video poker.

Alternate embodiments of the present invention are disclosed, wherein the side bet game of the present invention is integrated with other casino games, including Craps, Pai Gow, Pai Gow Poker, and others. The specific embodiments vary based upon the specific rules of the base casino game.

The present invention could also be played where the player places both the side bet and the base casino game wager simultaneously. If the player wins in the side bet game, then the side bet plus the amount won must be added to the simultaneously placed base casino game wager.

The preferred embodiment is a side bet game that is integrated with the base casino game called Blackjack, also know as Twenty-One. FIG. 1 shows a top view of a Blackjack table modified for the present invention. The preferred embodiment utilizes a playing surface 10, which includes a number of a player station 12, each of which include a casino game wager area 14, a black wager area 16, and a red wager area 18. A dealer will be seated apposition to a chip tray 20.

The game of Blackjack comprises one or more players playing against the dealer who represents the "house" or casino, and is played with one or more standard decks of playing cards. The casino typically offers single deck, double deck, and multiple deck games dealt out of a shoe. Each player places a wager and is then dealt two cards; the dealer is also dealt two cards with one face down, and one face up. The object of the game is for the players' hand to get closer to twenty-one than the dealer, without going over twenty-one. Once the deck is shuffled, the dealer takes the first card from the top of the deck and removes it from play, which is known in the art as "burning a card." The card that is removed from play is referred to as the burn card.

The side bet game of the preferred embodiment, affords each player an opportunity to place a side bet after the cards are shuffled on whether the burn card will be red or black in color. Any player that wants to place a side bet in the side bet game of the present invention must place a wager within either black wager area 16 or red wager area 18. A wager placed within black wager area 16 is considered a black wager. A wager placed within red wager area 18 is considered a red wager. Once all players have decided whether to place a black wager or a red wager, the dealer will begin the game by "burning a card." The dealer will then expose the burn card. If the burn card is of a black suit (spades, or clubs) then all players with a black wager (a wager within black wager area 16) will be paid even money on their side bet. The side bet plus the amount won on the side bet game must be placed within casino game wager area 14 therefore becoming a mandatory wager on the immediately following hand of Blackjack. All red wagers (wagers in red wager area 18) are lost, and are collected by the dealer. If the burn card is of a red suit (hearts, or diamonds) then all players with a red wager (a wager within red wager area 18) will be paid even money on their side bet. The side bet plus the amount won on the side bet game must be placed within casino game wager area 14 therefore becoming a mandatory wager on the immediately following hand of Blackjack. All black wagers (wagers in black wager area 16) are lost, and are collected by the dealer. Now that the side bet game wagers are settled, the base game of conventional Blackjack commences according to the standard Blackjack rules used by the casino. The casino could allow the players to increase their Blackjack wager by adding to the amount that is wagered within casino game wager area 14, regardless of the outcome of the side bet game.

As an alternative, the outcome of the side bet game of the preferred embodiment could be based upon the specific suit (spade, heart, diamond, or club) of the burn card. Each player station 12 would have four side bet areas in addition to casino game wagering area 14. Each side bet area would represent a specific suit, and players who place a side bet within a side bet area would be wagering that the burn card will be of the suit that the specific area represents. All winning side bets would be paid 3 to 1. Winning side bets plus all amounts won on the side bet game must be placed on casino game wager area 14. All losing side bets are collected by the dealer. The side bet games described above could be integrated with Blackjack together, wherein the player could wager on the specific suit and/or the color of the burn card.

The preferred embodiment of the present invention as described above does not provide for a percentage advantage to the casino or "bank" within the side bet game; the advantage of the side bet game is derived from forcing the player to wager their side bet, plus the amount won from the side bet game, on the base game of Blackjack wherein the casino does have a percentage advantage. However, a percentage advantage could be incorporated into the side bet game, using different methods. One method is where one or more non-value cards (i.e.: Jokers) are added to the deck, therefore creating an imbalance in the deck. When a non-value card appears as the "burn" card, all side bets (red and black, or specific suit) are lost, and are collected by the dealer.

The side bet game of the present invention could be integrated with many different base casino games. For example, a "coin toss" wager could be integrated to the base game of craps, and could be based on the roll of one die or the flip of a specially designed coin. The player would place a side bet on heads or tails, prior to the point being set. The dealer would then flip the coin, or the shooter would throw one die, with one, two, and three representing heads, and four, five, and six representing tails, If the player wins the side bet game, the side bet and the amount won must be placed on either the pass line or the don't pass line. The base craps game would then continue normally. The side bet could also be based on a specific roll of the dice, i.e.: 4,5 or 3,3, wherein the side bet could be paid 30 to 1 if the player chose a specific set of doubles, or 15 to 1 if the player chose a specific set of non-doubles.

A further embodiment of the present invention involves integrating the side bet game of the present invention into the base games of Pai Gow and Pai Gow Poker. Prior to the dominoes being distributed in Pai Gow, or the cards being dealt in Pai Gow Poker, a player position is selected, and this player position receives the first hand. The selection process is typically done in one of two ways. One way is to have a random number, one through seven, determined by a computer. Each number, one through seven, correlates to a player position at the table. Number one is the first player position to the right of the dealer, and number seven is the dealer position. When this selection method is used, the side bet game of the present invention could be integrated as follows: The player would be given an option of placing the side bet on low, (one, two, or three) or high, (five, six, or seven); the number four would be a push. If the player wins the side bet system, the side bet and the amount won must be wagered on the immediately following hand of the base game of Pai Gow or Pai Gow Poker. Alternatively, the player could be afforded the option to place a side bet on the number four. If the player wagers on the number four, and the number four is selected, the player wins, and will be paid six times the amount of their side bet, and the side bet and the entire amount won must be wagered on the immediately following hand of the base game of Pai Gow or Pai Gow Poker. The hand of the base game of Pai Gow or Pai Gow Poker will then be played according to the rules of the game. The second way that a player position is selected is based on the roll of three dice. The three dice are rolled and the position is selected by adding the total of the three dice, which correlates to a player position at the table. The numbers one, eight, and fifteen correlate to the first player position to the right of the dealer. The numbers seven, and fourteen correlate to the dealer position. When this selection method is used, the player would be given an option to place a side bet based on the outcome of the total of the dice roll, low (ten or less) or high (11 or higher,) or the players could place the side be based on specific numbers being rolled, each number paying various different predetermined odds.

The side bet game of the present invention could also be integrated into the base casino game of Big Six. An electronic random symbol generator that would generate either a win symbol or a lose symbol, would be added to the Big Six table. The game board would be modified to include side bet areas located adjacent to each of the already existing betting areas on the Big Six table. Players would place a side bet by placing a wager within the side bet area that is adjacent to the Big Six number they are wagering on. Once all bets are placed, the dealer spins the Big Six Wheel and activates the electronic random symbol generator. If the random symbol generator generates the lose symbol, the dealer will collect all wagers that are within a side bet area. If the random symbol generator generates the win symbol, the dealer will pay even money to all wagers that are within a side bet area. Next, the dealer will combine the side bet with the side bet winnings, and move the entire combined amount into the adjacent Big Six betting area, the player cannot collect the side bet or the side bet winnings unless the player wins the base game of Big Six. Finally, the dealer waits for the Big Six Wheel to stop, pays all winning Big Six wagers and collects all losing Big Six wagers, according to the rules and payouts of the base casino game of Big Six.

Additionally, to increase the speed at which the side bet game of the present invention is played, the casino may opt to force the players to place the side bet at the same time as the base casino game wager. If the player loses in the side bet game, the side bet is lost and the remaining base casino game wager is played as normal. If the player wins in the side bet game the side bet and the amount won are added to the already placed base casino game wager, and the base casino game will be played according to the rules of the base casino game.

Many casino games have been converted into multi-player, and single player video casino game machines. The side bet game of the present invention could be integrated with these video casino games using the same methods disclosed above. However, due to the unlimited possibilities inherent within the video graphic interface, variations of the integrated casino game are endless.

Figure 2:
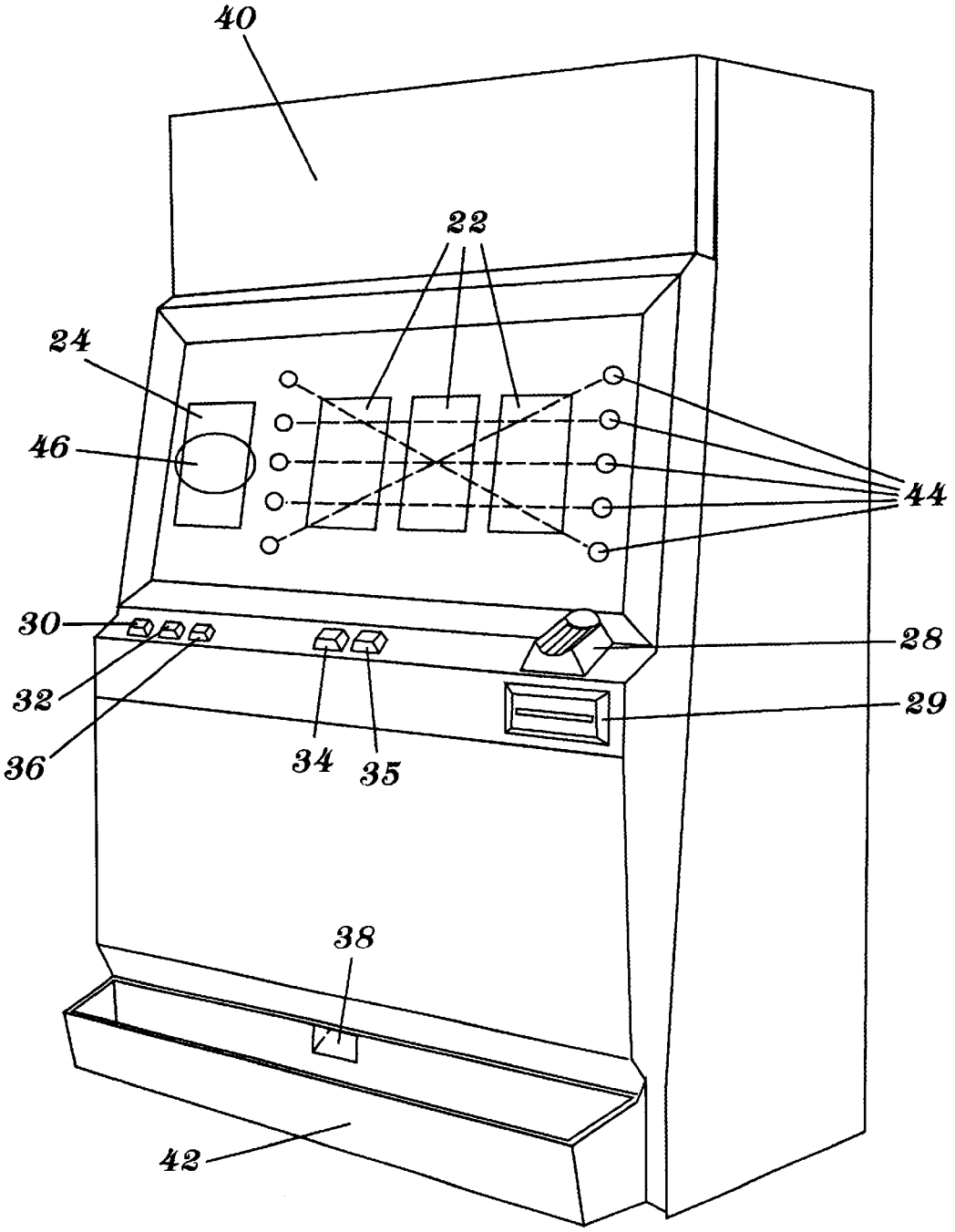
FIG. 2 Shows a perspective view of a game machine that could be useful for present invention.

An alternate embodiment of the present invention as shown in FIG. 2, integrates the side bet game of the present invention into a casino gaming machine as the base casino game. The casino game machine shown in FIG. 2 comprises three same, or somewhat similar rotatable reels 22, which comprise a variety of symbols, the viewable portion of which has five of a payline 44 each of which is directed across all three rotatable reels 22, and a additional reel 24, which comprises an equal number of symbols and blanks, wherein a stop position is designated by a bonus pay area 46. A plurality of winning combinations associated with the base casino game are displayed within a pay table area 40. A player inserts money into the casino game machine either by inserting coins into a coin slot 28, or by inserting paper money into a bill validator 29. All money that is inserted into the casino game machine is held in the casino game machine as credits. The player can wager these credits by pressing a "Bet One" button 30, which will cause one held credit to be wagered on the casino game, or by pressing a "Bet Max" button 32, which will wager the maximum amount on the casino game from the credits. After the player has wagered the desired amount, the player starts the casino game by pressing a "Spin Reels" button 34, or by pressing a "Play Bonus" button 35. If "Spin Reels" Button 34 is pressed, rotatable reels 22 will simultaneously begin to spin, each of rotatable reels 22 will stop, and if a winning combination exists from the winning combinations displayed in pay table area 40 along payline 44, then the player will receive a payout based upon the arrived at winning combination and the amount wagered on that specific payline 44. If there are no winning combinations achieved, then the player's wager is lost. If "Play Bonus" button 35 is pressed then the player has opted to bet all credits wagered on the side bet game. Additional reel 24 begins to spin, and shortly thereafter additional reel 24 stops. If additional reel 24 stops, and a blank is viewable in bonus pay area 46 the player loses the mount wagered and the integrated casino game is over. If additional reel 24 stops, and a symbol is viewable in bonus pay area 46 the amount wagered on the side bet game is doubled, and is automatically wagered on the immediately following base casino game which begins automatically as if "Spin Reels" button 34 were pressed, without the player having to press "Spin Reels" button 34. When the player is done playing and wants to cash out, the player will press a "Cash Out" button 36, which prompts the casino game machine to disburse the total credits held, in coins to the player. The disbursed coins will be dropped into a coin receiving tray 42 through a coin payout opening 38. If preferred, additional reel 24 could be replaced by an alternate random device for the present embodiment, such as a wheel with a plurality of indicia upon it, or a video display of a die or a card.

The side bet game of the present invention described above could be implemented wherein the player would only lose a portion of the side bet when a blank is viewable in bonus pay area 46. For example, the player would place a wager by pressing "Bet One" button 30, or by pressing "Bet Max" button 32. The player would then press "Play Bonus" button 35. If additional reel 24 stops, and a symbol is viewable in bonus pay area 46 the amount wagered on the side bet game is doubled, and is automatically wagered on the immediately following round of the base casino game which begins automatically as if "Spin Reels" button 34 were pressed, without the player having to press "Spin Reels" button 34. If additional reel 24 stops, and a blank is viewable in bonus pay area 46, then half of the amount wagered on the side bet system is lost, and the remaining half is automatically wagered on the immediately following casino game which begins automatically as if "Spin Reels" button 34 were pressed, without the player having to press "Spin Reels" button 34. This side bet game as described has a high percentage advantage to the player. In order for this side bet game to operate properly, the percentage advantage must be offset. One way to offset this percentage advantage is to provide two times more blanks on additional reel 24 than there are symbols. Another way is to adjust the percentage advantage of the base casino game in order to compensate for the percentage advantage in favor of the player within the side bet game.

Video poker is another casino game that could benefit from the side bet game of the present invention. When integrated with video poker the side bet game could function as follows. A player that wagers the maximum number of coins would be offered a chance to "double up" their wager. If the player chooses to try to "double up," a random card will be displayed, face down. The player will try to guess whether that card is high (Nine through Ace) or low (Two through Seven); an Eight will be a push. After the player chooses high or low, the face down card is displayed face up. If the player chose incorrectly, the player loses the wager and the game ends. If the player chose correctly, the amount wagered is doubled and then automatically wagered on the immediately following hand of the base casino game video poker, which begins automatically. If the face down card is an Eight (a push,) the amount the player wagered is unchanged and automatically wagered on the immediately following hand of video poker, which begins automatically. The side bet game of the present invention as described above could be offered to the player more than once. The player would be allowed to "Double Up" as described above, and if the player chose correctly, or the face down card is an Eight (a push,) the player would be offered another opportunity to "Double Up." The "Double Up" side bet game would continue repeatedly until the player chooses incorrectly and loses, or until the player decides to place the wager and all amounts won in the "Double Up" side bet game on the base casino game video poker.

There are many ways that the side bet game of the present invention could be integrated into any base casino game or base casino game machine. The structure of the side bet game would vary based on the various elements of the specific base casino game that the side bet game is integrated with. The side bet game of the present invention does not need to be based on elements that are present within the base casino game that the side bet game is integrated with. The side bet game of the present invention could be based on an added element or added elements, such as a dice roll added to BlackJack, or the suit, or color, of a card dealt in craps. More than one card could be dealt, prior to the beginning of the base casino game, and the side bet could be based on the combination of these cards or any one of these cards. The side bet game of the present invention could be based on the outcome of an electronically generated event such as a video display of a card, series of cards, dice roll, spin of a wheel, etc. The side bet game of the present invention could be offered multiple times prior to the start of the base casino game. The novelty of the side bet game of the present invention is that the side bet and all amounts won on the side bet must be wagered on the base casino game.

Accordingly, it is apparent that the present invention provides a method whereby a side bet game that increases the amount wagered per hand can be integrated into a base casino game. Additionally, the present invention could be implemented for use on a computer platform, where the dealer and/or base casino game elements are replaced by electronic hardware and software, whether distributed in a boxed software package, or over the internet, or an internet wagering site.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

We claim:

1. A side bet game method wherein the side bet game is played prior to playing a base casino game comprising the steps of:

a) a player placing a side bet to participate in a side bet game;

b) the side bet game being played to a outcome, prior to beginning play of a base casino game;

c) if the outcome of the side bet game results in a win, the side bet is increased and parlayed into the base casino game as a casino game wager, and play of the base casino game begins;

d) if the outcome of the side bet game results in a push, the side bet is parlayed into the base casino game as a casino game wager, and the play of the base casino game begins; and e) if the outcome of the side bet game is a loss, then the player loses the side bet, and the player may place a casino game wager, and the play of the base casino game begins.

2. A side bet game method wherein the side bet game is played prior to playing a base casino game according to claim 1 further comprising the step of allowing the player to add to the casino game wager after the outcome of the side bet game has been determined, but prior to beginning play of the base casino game.

3. A side bet game method wherein the side bet game is played prior to playing a base casino game according to claim 1 wherein the base casino game is Big Six, and the outcome of the side bet game is determined apart from the Big Six wheel.

4. A side bet game method wherein the side bet game is played prior to playing a base casino game according to claim 1 wherein the base casino game is Blackjack and the outcome of the side bet game is determined by the suit, or color of one or more dealt card(s).

5. A side bet game method wherein the side bet game is played prior to playing a base casino game according to claim 1 wherein the base casino game is Craps and the outcome of the side bet game is determined by a flip of a coin.

6. A side bet game method wherein the side bet game is played prior to playing a base casino game according to claim 1 wherein the base casino game is a slot machine and the outcome of the side bet game is programmed into the slot machine.

7. A side bet game method wherein the side bet game is played prior to playing a base casino game according to claim 1 wherein the base casino game is a video gaming machine and the outcome of the side bet game is programmed into the video gaming machine.

8. A side bet game method wherein the side bet game is played prior to playing a base casino game according to claim 1 further comprising the step of; if the outcome of the side bet game is a win, the player is given an option to apply the side bet to the side bet game again.

9. A side bet game method wherein the side bet game is played prior to playing a base casino game according to claim 1 wherein the side bet game and the base casino game are programmed on a computer that has been set up as a server, and the player plays from a global computer information network like a internet.

10. A side bet game method wherein the side bet game is played prior to playing a base casino game comprising the steps of:

a) a player placing a side bet to participate in a side bet game;

b) the side bet game being played to a outcome, prior to beginning play of a base casino game;

c) if the outcome of the side bet game results in a win, the side bet is increased and parlayed into the base casino game as a casino game wager, and play of the base casino game begins;

d) if the outcome of the side bet game results in a push, the side bet is parlayed into the base casino game as a casino game wager, and play of the base casino game begins; and e) if the outcome of the side bet game results in a loss, the side bet is decreased and parlayed into the base casino game as a casino game wager, and play of the base casino game begins.

11. A side bet game method wherein the side bet game is played prior to playing a base casino game according to claim 10 further comprising the step of allowing the player to increase the casino game wager after the outcome of the side bet game has been determined, but prior to beginning play of the base casino game.

12. A side bet game method wherein the side bet game is played prior to playing a base casino game according to claim 10 wherein the base casino game is Big Six, and the outcome of the side bet game is determined apart from the Big Six wheel.

13. A side bet game method wherein the side bet game is played prior to playing a base casino game according to claim 10 wherein the base casino game is Blackjack and the outcome of the side bet game is determined by the suit, or color of one or more dealt card(s).

14. A side bet game method wherein the side bet game is played prior to playing a base casino game according to claim 10 wherein the base casino game is Craps and the outcome of the side bet game is determined by a flip of a coin.

15. A side bet game method wherein the side bet game is played prior to playing a base casino game according to claim 10 wherein the base casino game is a slot machine and the outcome of the side bet game is programmed into the slot machine.

16. A side bet game method wherein the side bet game is played prior to playing a base casino game according to claim 10 wherein the base casino game is a video gaming machine and the outcome of the side bet game is programmed into the video gaming machine.

17. A side bet game method wherein the side bet game is played prior to playing a base casino game according to claim 10 further comprising the step of; if the outcome of the side bet game is a win, the player is given an option to apply the side bet to the side bet game again.

18. A side bet game method wherein the side bet game is played prior to playing a base casino game according to claim 10 wherein the side bet game and the base casino game are programmed on a computer that has been set up as a server, and the player plays from a global computer information network like a internet.

19. A side bet game method wherein the side bet game is played prior to playing a base casino game comprising the steps of:

a) a player placing a side bet to participate in a side bet game;

b) the side bet game being played to a outcome, prior to beginning play of a base casino game;

c) if the outcome of the side bet game is a win, the side bet is increased by a predetermined amount, and the side bet is applied to the base casino game as a casino game wager;

d) if the outcome of the side bet game is a push or a loss, then the side bet remains unchanged and the side bet is applied to the base casino game as a casino game wager; and e) play of the base casino game begins.

20. A side bet game method wherein the side bet game is played prior to playing a base casino game according to claim 19 further comprising the step of allowing the player to increase the casino game wager after the outcome of the side bet game has been determined, but prior to beginning play of the base casino game.

21. A side bet game method wherein the side bet game is played prior to playing a base casino game according to claim 19 wherein the base casino game is Big Six, and the outcome of the side bet game is determined apart from the Big Six wheel.

22. A side bet game method wherein the side bet game is played prior to playing a base casino game according to claim 19 wherein the base casino game is Blackjack and the outcome of the side bet game is determined by the suit, or color of one or more dealt card(s).

23. A side bet game method wherein the side bet game is played prior to playing a base casino game according to claim 19 wherein the base casino game is Craps and the outcome of the side bet game is determined by a flip of a coin.

24. A side bet game method wherein the side bet game is played prior to playing a base casino game according to claim 19 wherein the base casino game is a slot machine and the outcome of the side bet game is programmed into the slot machine.

25. A side bet game method wherein the side bet game is played prior to playing a base casino game according to claim 19 wherein the base casino game is a video gaming machine and the outcome of the side bet game is programmed into the video gaming machine.

26. A side bet game method wherein the side bet game is played prior to playing a base casino game according to claim 19 wherein the side bet game and the base casino game are programmed on a computer that has been set up as a server, and the player plays from a global computer information network like a internet.

* * * * *